US006039595A

United States Patent [19]

Tseng et al.

[11] Patent Number: 6,039,595

[45] Date of Patent: Mar. 21, 2000

[54] ELECTRICAL CONNECTOR

[75] Inventors: Gwou-Jong Tseng; Yuh-Huey Kang, both of Tu-Chen, Taiwan

[73] Assignee: Hon Hai Precison Ind. Co., Ltd., Taipei Hsien, Taiwan

[21] Appl. No.: 09/366,160

[22] Filed: Aug. 3, 1999

[30] Foreign Application Priority Data

Apr. 27, 1999 [TW] Taiwan ..... 88206557

[51] Int. Cl.[7] ..... H01R 13/64

[52] U.S. Cl. ..... 439/377; 439/157; 439/637

[58] Field of Search ..... 439/377, 160, 439/157, 64, 636, 637

[56] References Cited

U.S. PATENT DOCUMENTS

| | | | |
|---|---|---|---|
| 5,571,025 | 11/1996 | Arai et al. | 439/160 |
| 5,634,803 | 6/1997 | Cheng et al. | 439/160 |
| 5,672,069 | 9/1997 | Cheng et al. | 439/160 |

FOREIGN PATENT DOCUMENTS

| | | | |
|---|---|---|---|
| 2732519 | 2/1979 | Germany | 439/377 |

*Primary Examiner*—Gary F. Paumen
*Attorney, Agent, or Firm*—Wei Te Chung

[57] ABSTRACT

An electrical connector for connecting a memory module to a circuit board comprises an elongate housing, a number of contacts and an ejector. The housing includes an elongate body and a pair of arms extending from opposite ends of the body. The body includes a plurality of cavities formed in opposite side walls thereof and an elongate slot defined between the side walls in communication with the cavities for insertion of the memory module. The slot is slightly wider than the memory module. Each arm defines a channel in an inner surface thereof in communication with the slot of the body for guiding the memory module into the slot. A pair of elongate ribs project from inner surfaces of opposite side walls of each arm for abutting against the memory module thereby restricting movement of the memory module along a lateral direction. The contacts are received in the cavities of the housing and exposed to the slot of the housing for mating with the memory module. The ejector is secured to the housing for ejecting the memory module from the slot of the housing.

3 Claims, 9 Drawing Sheets

ELECTRICAL CONNECTOR

FIELD OF THE INVENTION

The present invention is related to an electrical connector for mating with a memory module, and especially to an electrical connector which can securely mate with the memory module.

BACKGROUND OF THE INVENTION

As disclosed in Taiwan Patent Application Nos. 84103160 and 85215322, a conventional electrical connector includes an elongate slot with a plurality of contacts exposed therein for mating with a memory module thereby implementing electrical connection between the memory module and a circuit board.

Referring to FIGS. 1 and 2, a conventional electrical connector includes an elongate housing 102 which includes a body 104 and a pair of arms 106 extending from opposite ends of the body 104. An elongate slot 108 is defined in a central portion of the body 104 for insertion of a memory module 110. Generally, the slot 108 is slightly wider than the memory module 110. The arms 106 each define a channel 112 in an inner surface thereof in communication with the slot 108 for guiding the memory module 110 into the slot 108.

Referring to FIG. 3A, a plurality of contacts 114 is received in the housing 102 and exposed in the slot 108. When inserted into the slot 108 of the housing 102, the memory module 110 mates with the contacts 114 to implement electrical connection therebetween. However, the memory module 110 is easily moved along the lateral direction D, since the memory module 110 is not supported by the contacts 114. Thus, the reliability of the electrical connection between the memory module 110 and the contacts 114 is low.

Referring to FIG. 3B, a pair of protrusions 116 is formed on each inner surface of the slot 108 to restrict movement of the memory module 110 along the lateral direction D due to surfaces of the protrusions 116 abutting against the memory module 110. However, due to large contacting surfaces of the protrusions 16 with the memory module 110, a large friction force occurs between the protrusions 116 and the memory module 110 during insertion/withdrawal of the memory module 110 into/from the slot 108. Thus, a large force is needed to insert/withdraw the memory module 110 into/from the connector, which causes an inconvenience for implementing a replacement of the memory module 110.

SUMMARY OF THE INVENTION

Accordingly, an object of the present invention is to provide an electrical connector which can securely connect with a memory module.

Another object of the present invention is to provide an electrical connector which can easily connect with a memory module.

To achieve the objects mentioned above, an electrical connector of the present invention for connecting a memory module to a circuit board comprises an elongate housing, a plurality of contacts and an ejector. The housing includes an elongate body and a pair of arms extending from opposite ends of the body. The body includes a plurality of cavities formed in opposite side walls thereof and an elongate slot defined between the side walls in communication with the cavities for insertion of the memory module. The slot is slightly wider than the memory module. Each arm defines a channel in an inner surface thereof in communication with the slot of the body for guiding the memory module into the slot. A pair of elongate ribs project from inner surfaces of opposite side walls of each arm for abutting against the memory module thereby restricting movement of the memory module along a lateral direction. The contacts are received in the cavities of the housing and exposed to the slot of the housing for mating with the memory module. The ejector is secured to the housing for ejecting the memory module from the slot of the housing.

Additional objects, features, and advantages of the invention will become apparent to those skilled in the art upon consideration of the following detailed description of preferred embodiments.

DETAILED DESCRIPTION OF THE INVENTION

Figure 1:
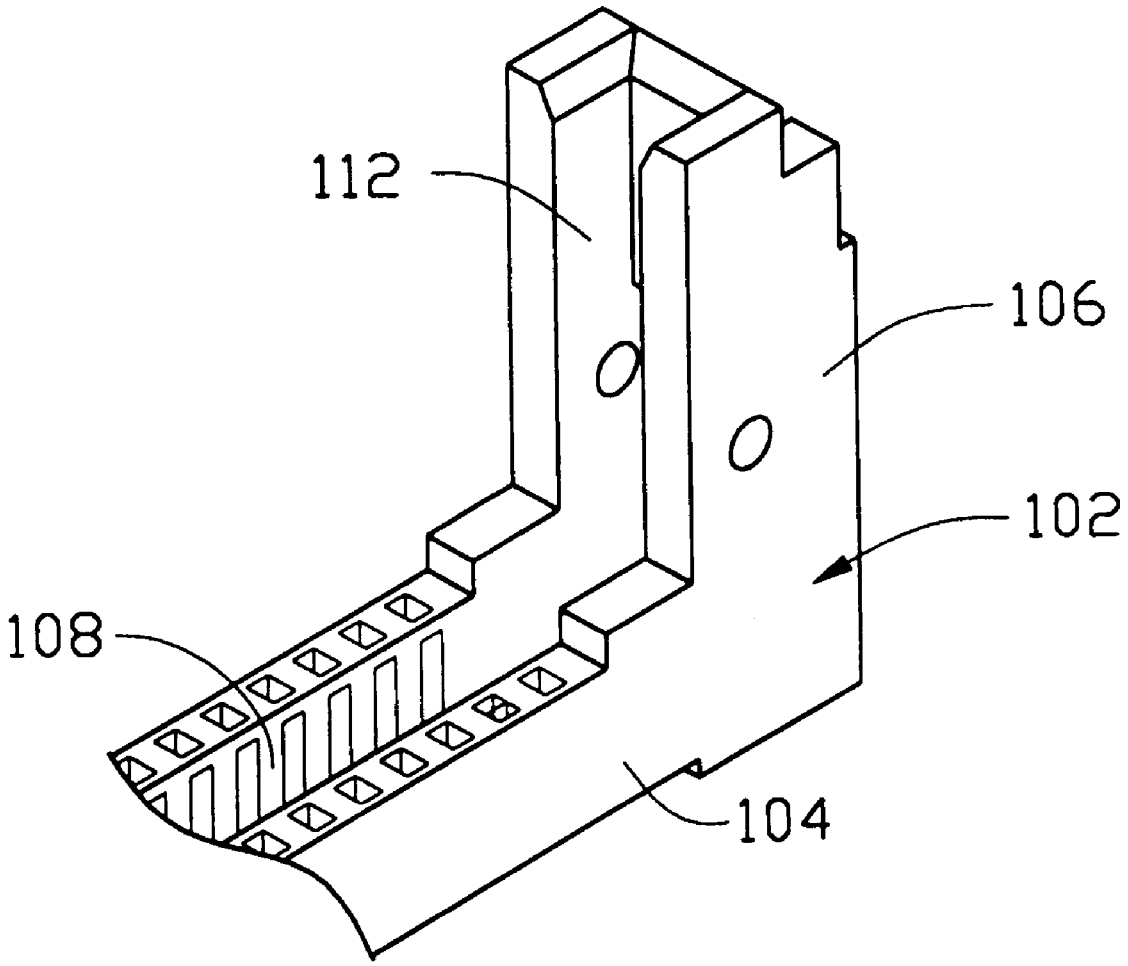
FIG. 1 (PRIOR ART)
FIG. 1 is a fragmentary view of a housing of a conventional electrical connector.
Figure 2:
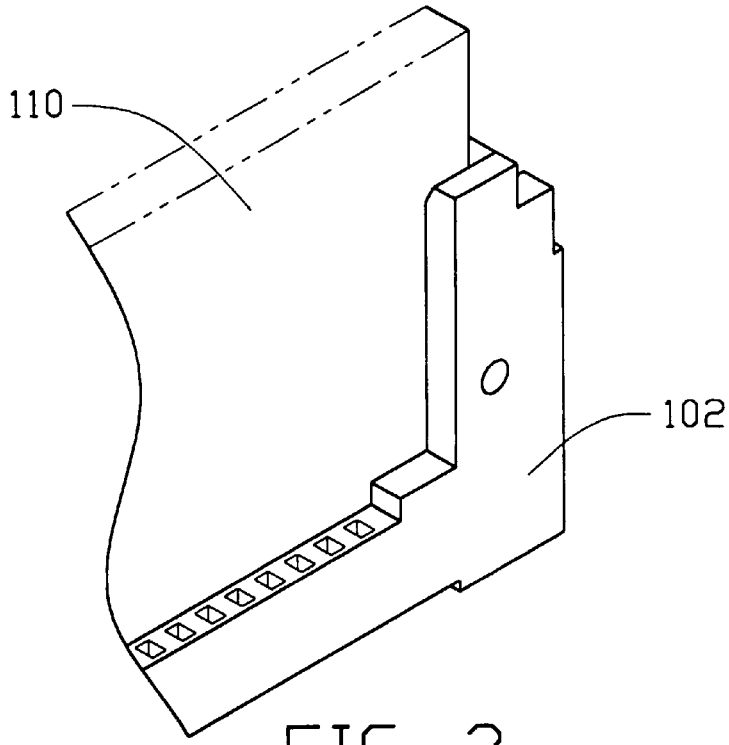
FIG. 2 (PRIOR ART)
FIG. 2 is a fragmentary view of the conventional electrical connector with a memory module inserted therein.
Figure 3A:
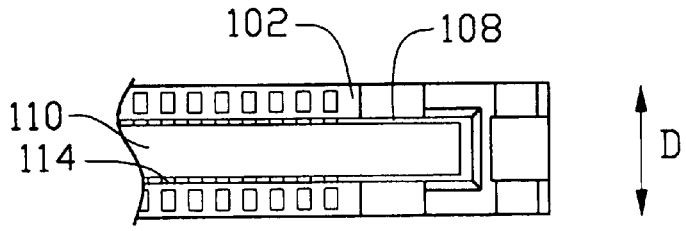
FIG. 3A (PRIOR ART)
FIG. 3A is a fragmentary, top plan view of the conventional electrical connector with the memory module inserted therein.
Figure 3B:
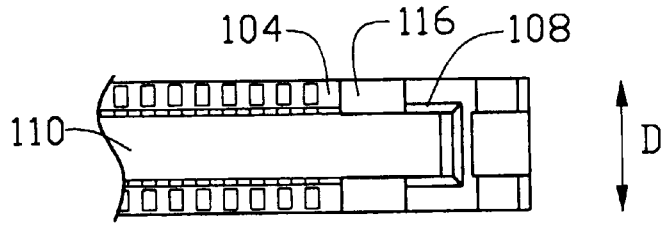
FIG. 3B (PRIOR ART)
FIG. 3B is a fragmentary, top plan view of another conventional electrical connector with the memory module inserted therein.
Figure 4:
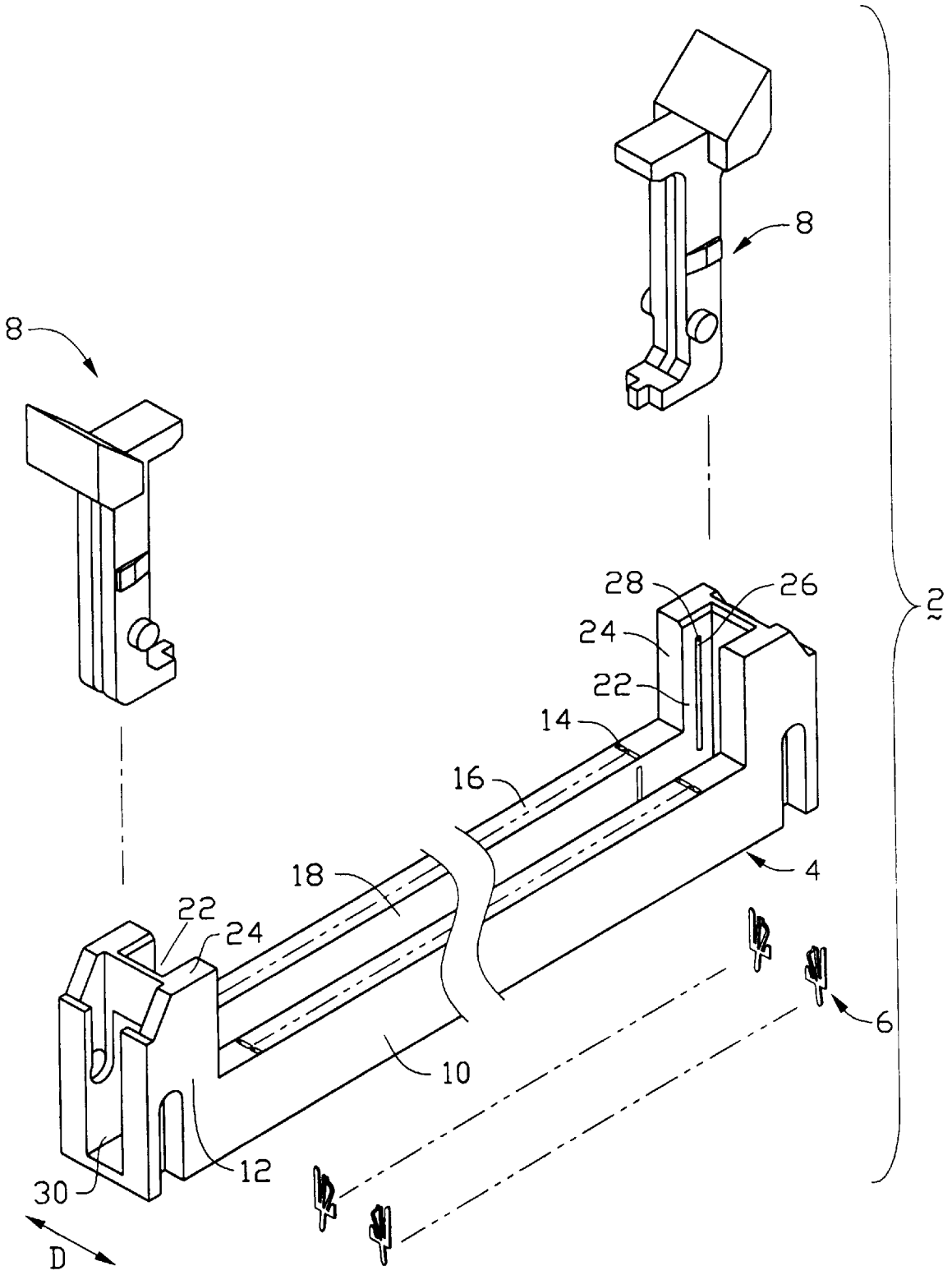
FIG. 4 is an exploded view of an electrical connector embodying the concepts of the present invention.
Figure 5:
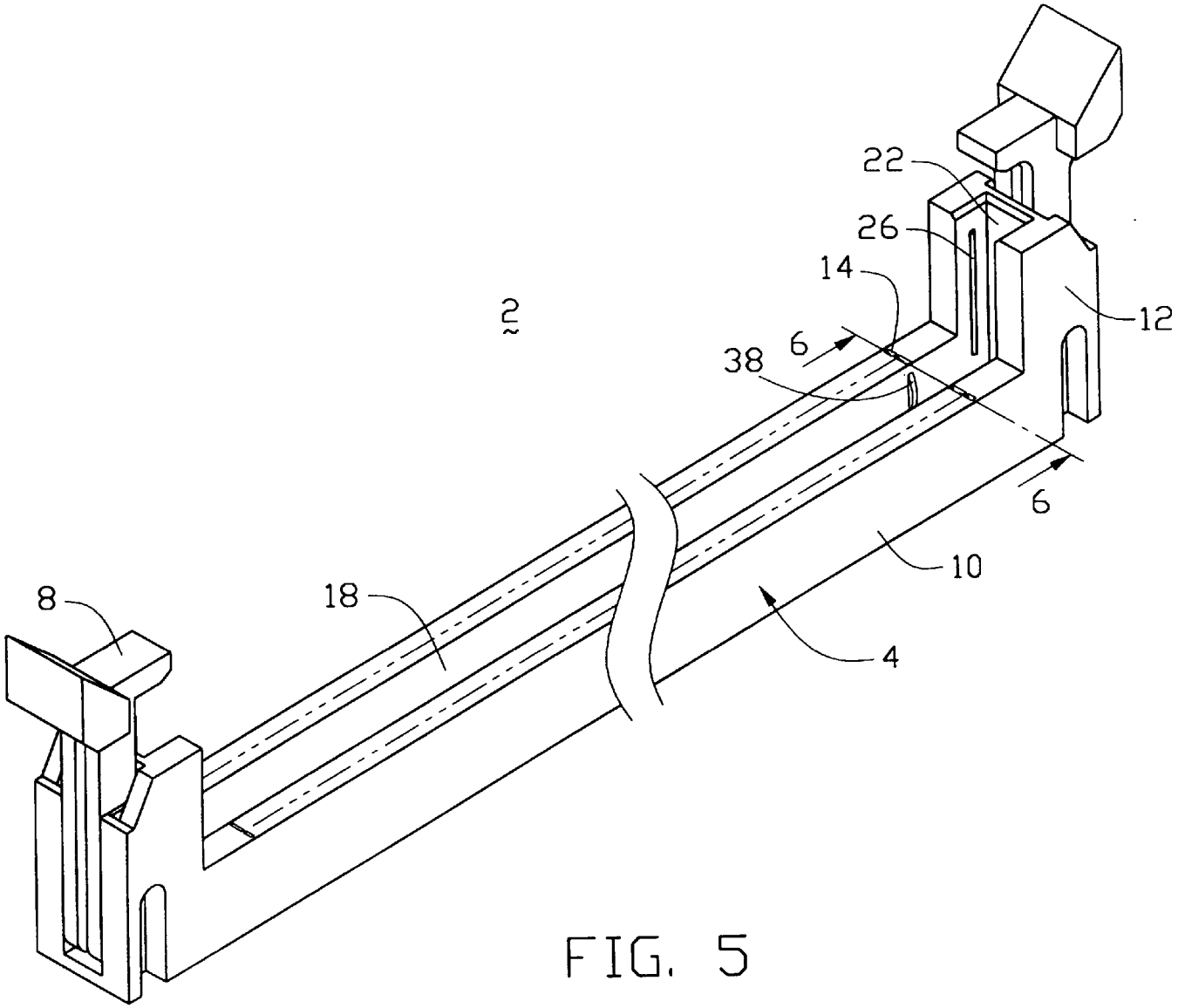
FIG. 5 is an assembled view of FIG. 4.
Figure 6:
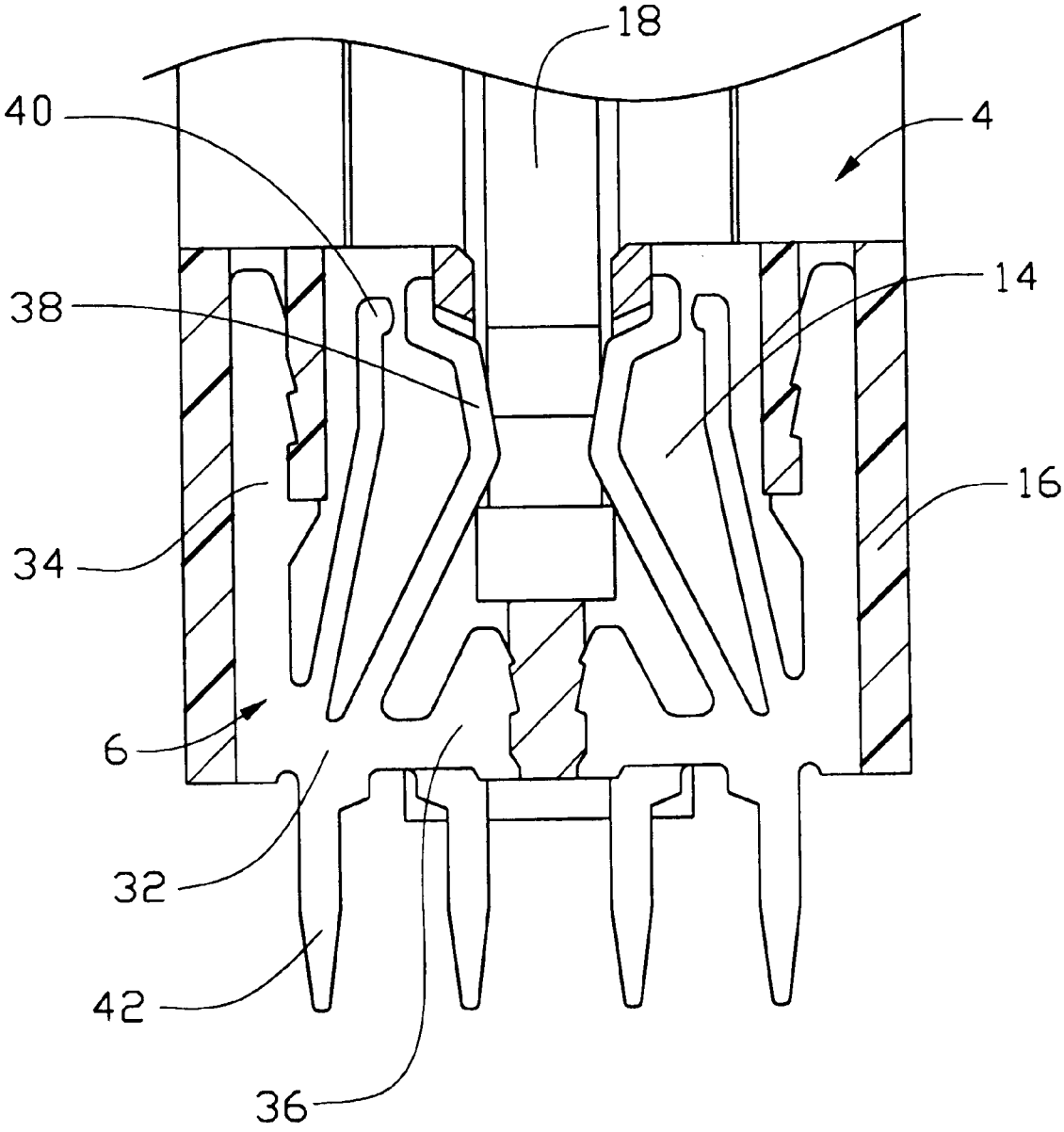
FIG. 6 is a cross sectional view of FIG. 5 taken along line 6—6.
Figure 7:
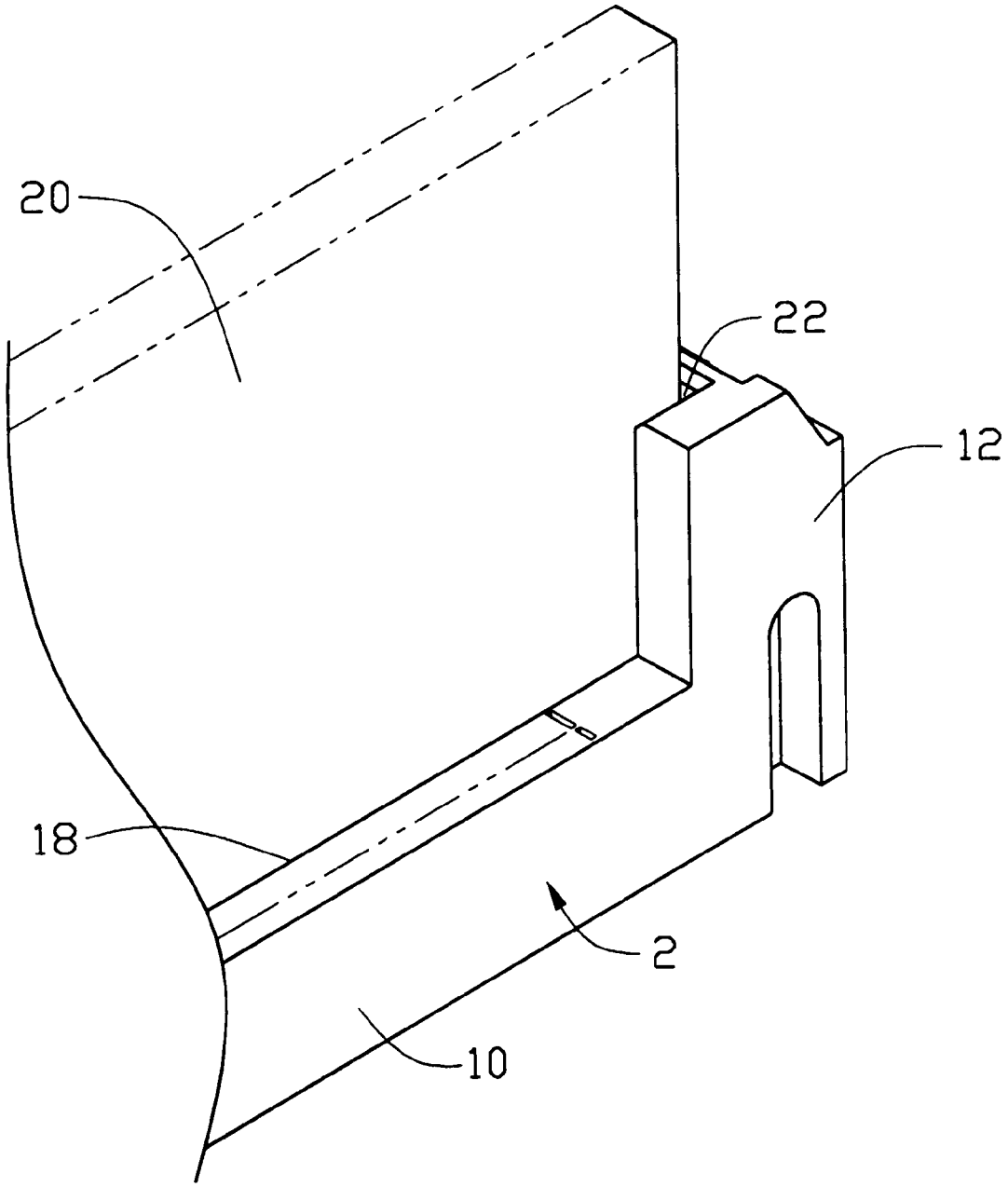
FIG. 7 is a fragmentary view of the electrical connector with a memory module inserted therein.
Figure 8:
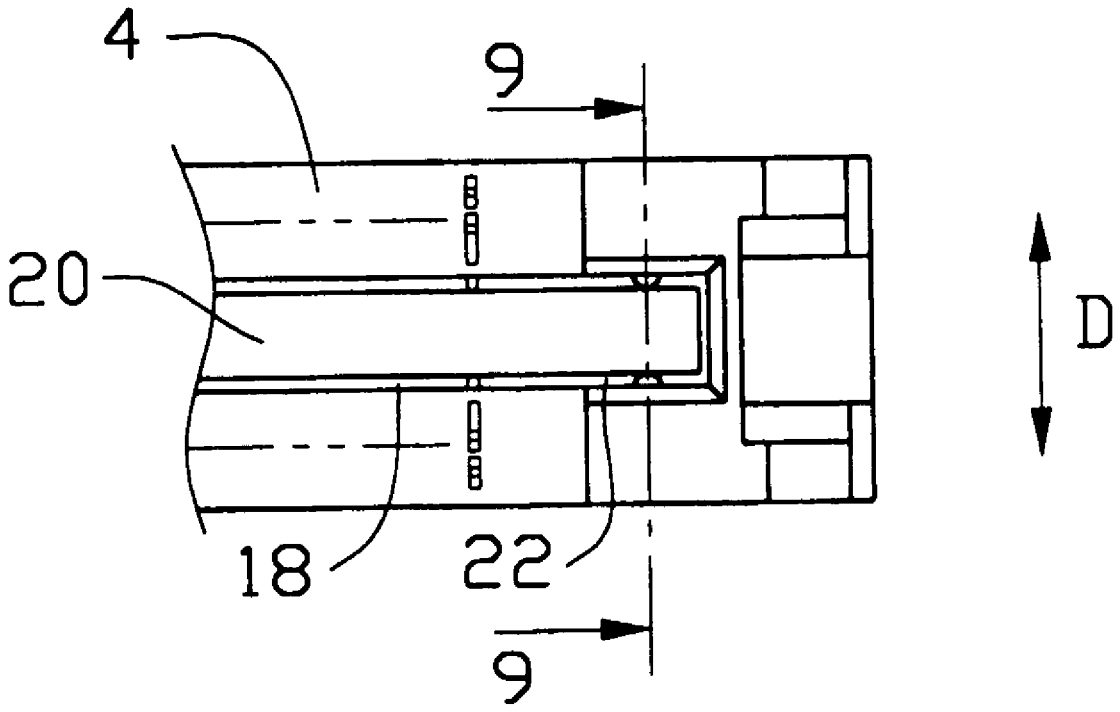
FIG. 8 is a fragmentary, top plan view of FIG. 7.
Figure 9:
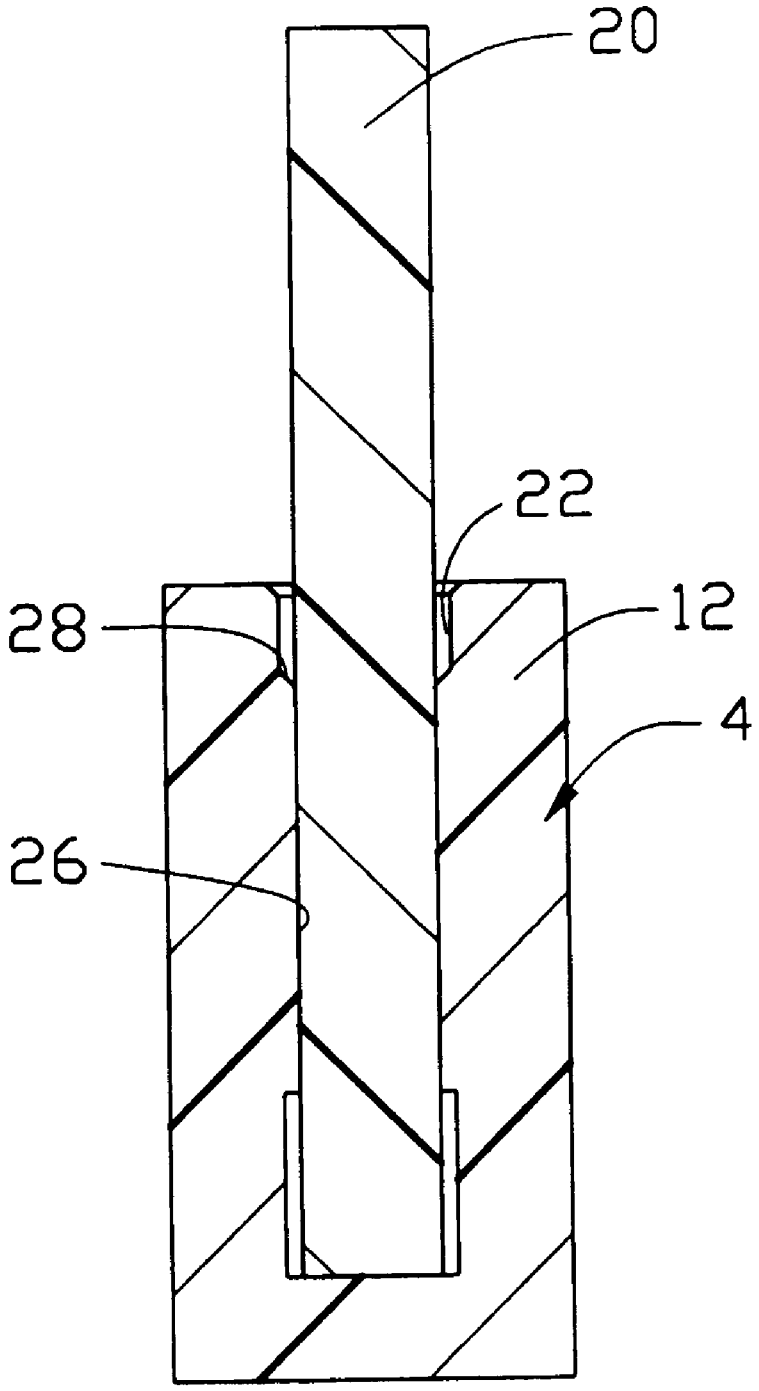
FIG. 9 is a cross sectional view of FIG. 8 taken along line 9—9.

Referring to FIGS. 4–9, an electrical connector 2 in accordance with the present invention includes an elongate housing 4, a plurality of contacts 6 received in the housing 4, and a pair of ejectors 8 secured to the housing 4.

The elongate housing 4 includes an elongate body 10 and a pair of arms 12 extending from opposite ends of the body 10. A plurality of cavities 14 is formed in opposite side walls 16 of the body 10 for receiving the contacts 6 therein. An elongate slot 18 is defined between the two side walls 16 of the body 10 in communication with the cavities 14 for insertion of a memory module 20. The slot 18 is slightly wider than the memory module 20.

The arms 12 each define a channel 22 in an inner surface thereof in communication with the slot 18 for guiding the memory module 20 into the slot 18. A pair of elongate ribs 26 is formed along a height of inner surfaces of opposite side walls 24 of each arm 12 for abutting against the memory module 20 thereby restricting movement of the memory module 20 along a lateral direction D. A chamfer 28 is formed in a top portion of each rib 26 for guiding the memory module 20 to abut against the ribs 26. The surface of each rib 26 is arcuate. Thus, the memory module 20 and each rib 26 have a substantially linear contact therebetween, thereby reducing a frictional force formed between the ribs 26 and the memory module 20 during insertion.

Furthermore, each arm 12 includes a receiving recess 30 opposite the channel 22 in communication therewith for receiving the corresponding ejector 8. The ejectors 8 are pivoted outwards to eject the memory module 20 from the slot 18 of the housing 4.

Each contact 6 includes a base portion 32, first and second fixing portions 34, 36 upwardly extending from opposite ends of the base portion 32, a mating portion 38 extending from the body portion 32 between the first and second fixing portions 34, 36, a conductive portion 40 extending from the base portion 32 between the first fixing portion 34 and the mating portion 38, and a tail portion 42 downwardly extending from the base portion 32.

The mating portion 38 is exposed to the slot 18 of the housing 4 after being assembled in the housing 4. When the memory module 20 mates with the mating portions 38, the mating portions 38 are deflected to contact the corresponding conductive portions 40 thereby increasing transmittal paths of signals to reduce the transmittal resistance of the contacts 6.

Figure 10:
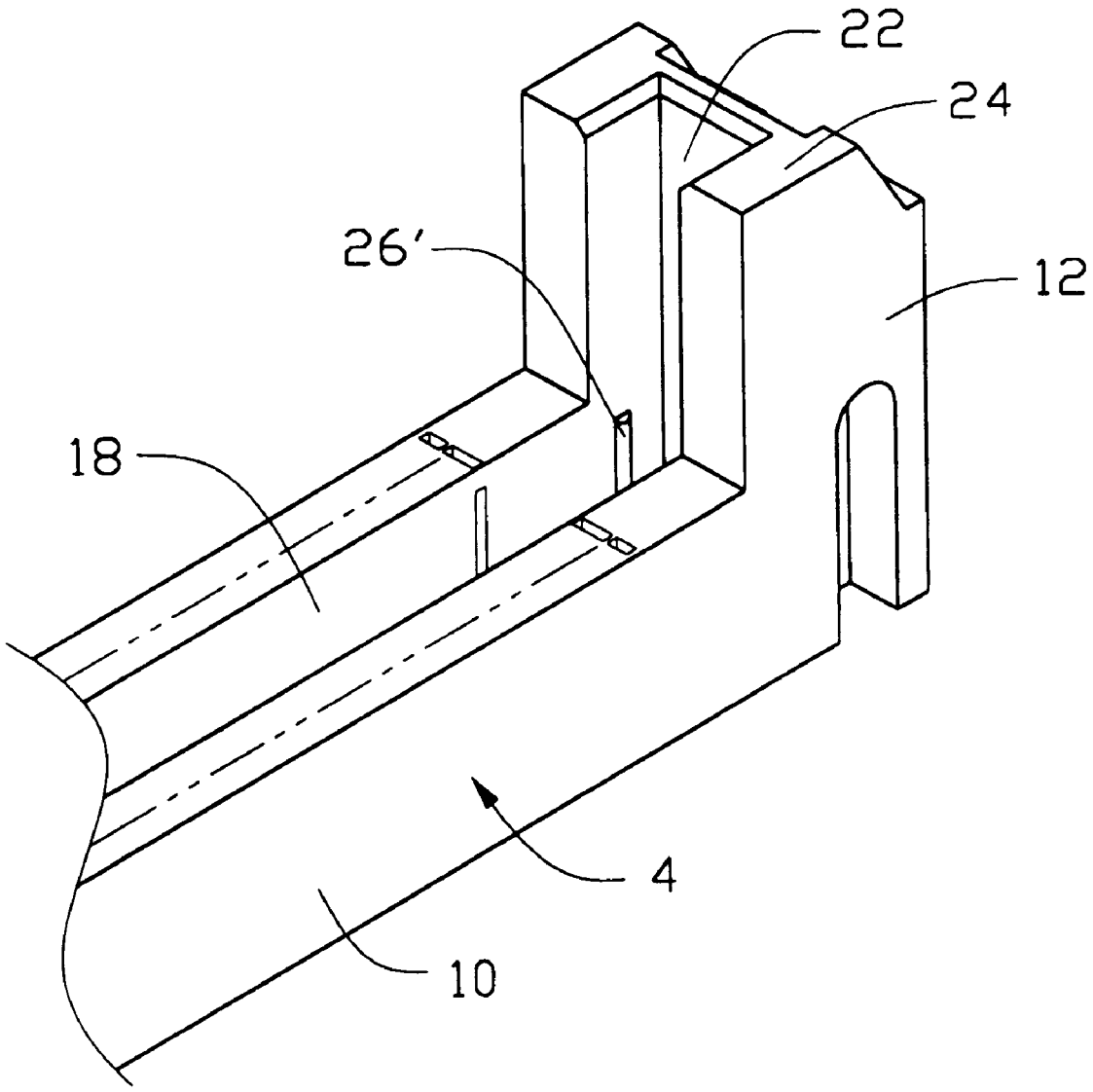
FIG. 10 is a fragmentary view of a housing of a second embodiment of the present invention.

Referring to FIG. 10, in a second embodiment of the present invention, each arm 12 forms a pair of ribs 26' extending from the opposite inner surfaces of the side walls 24 thereof. The ribs 26' are formed on a bottom portions of the side walls 24 and are exposed to the channel 22 proximate the slot 18 of the body 10 of the housing 4.

Although the invention has been described in detail with reference to preferred embodiments, variations and modifications exist within the scope and the spirit of the invention as described and defined in the following claims.

We claim:

1. An electrical connector adapted for connecting a memory module to a circuit board, comprising:

an elongate housing including:

an elongate body including a plurality of cavities formed in opposite side walls thereof and an elongate slot defined between the two side walls in communication with the cavities for insertion of the memory module, the slot being slightly wider than the memory module; and a pair of arms extending from opposite ends of the body, each arm defining a channel in an inner surface thereof in communication with the slot of the body for guiding the memory module into the slot, a pair of elongate ribs projecting from opposite inner surfaces of opposite side walls of each arm for abutting against the memory module thereby restricting movement of the memory module along a lateral direction;

a plurality of contacts received in the cavities of the housing and exposed to the slot for mating with the memory module; and an ejector secured to the housing for ejecting the memory module from the slot of the housing;

wherein each rib projects from a lower portion of the inner surface of the side wall of the arm proximate the slot of the body to an upper portion of the arm;

wherein a chamfer is formed in a top portion of each rib for guiding the memory module to abut against the rib;

wherein the surface of each rib is arcuate for making a line contact with the memory module thereby reducing a frictional force between the ribs and the memory module.

2. The electrical connector as described in claim 1, wherein each rib is formed along a length of the inner surface of the side wall of the arm.

3. The electrical connector as described in claim 1, wherein each contact includes a base portion, a mating portion extending from the base portion for mating with the memory module, and a conductive portion extending from the base portion for electrically connecting with the mating portion when the mating portion mates with the memory module.

* * * * *